US007424875B2

(12) United States Patent
Hayase et al.

(10) Patent No.: US 7,424,875 B2
(45) Date of Patent: Sep. 16, 2008

(54) PHASE CONTROLLER AND CAM SHAFT PHASE CONTROLLER FOR INTERNAL COMBUSTION ENGINE

(75) Inventors: Isao Hayase, Chiyoda-ku (JP); Atsushi Watanabe, Chiyoda-ku (JP); Seiji Suga, Chiyoda-ku (JP); Masahiko Watanabe, Chiyoda-ku (JP); Yoshinori Ichinosawa, Chiyoda-ku (JP); Takanori Sawada, Chiyoda-ku (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/654,523

(22) Filed: Jan. 18, 2007

(65) Prior Publication Data

US 2007/0169732 A1 Jul. 26, 2007

(30) Foreign Application Priority Data

Jan. 26, 2006 (JP) ..... 2006-017733

(51) Int. Cl.
*F01L 1/34* (2006.01)

(52) U.S. Cl. ..... 123/90.17; 123/90.15; 123/90.31

(58) Field of Classification Search ..... 123/90.17, 123/90.31, 90.15

See application file for complete search history.

(56) References Cited

U.S. PATENT DOCUMENTS 6,276,322 B1 * 8/2001 Sekiya et al. ..... 123/90.17

FOREIGN PATENT DOCUMENTS

JP 11-343819 A 12/1999
JP 2001-241307 A 9/2001

* cited by examiner

*Primary Examiner*—Zelalem Eshete
(74) *Attorney, Agent, or Firm*—Crowell & Moring LLP

(57) ABSTRACT

A parallel guide portion as an integral structure of a sprocket and a vane, as well as a slant guide portion, are arranged alternately on the same circumference, with circumferential gaps being formed between said guide portion and the parallel guide portion, said guide portion having a shape such that the circumferential gaps become smaller in one axial direction of a cam shaft. Wedge members are disposed in the circumferential gaps respectively and are moved in one axial direction to fill up the circumferential gaps, thereby fixing the phase between the sprocket and the vane into a locked state. The wedge angle of each wedge member is set sufficiently small and, by utilizing varying torques acting on the cam shaft, said members are each moved and locked in one axial direction with a spring. Said members are actuated in an opposite axial direction with oil pressure to release the locked state, thereby permitting a phase angle control. By utilizing a varying torque acting on the cam shaft, the phase of the cam shaft is returned for itself to an intermediate position and is locked without looseness.

19 Claims, 10 Drawing Sheets

(A-A section)

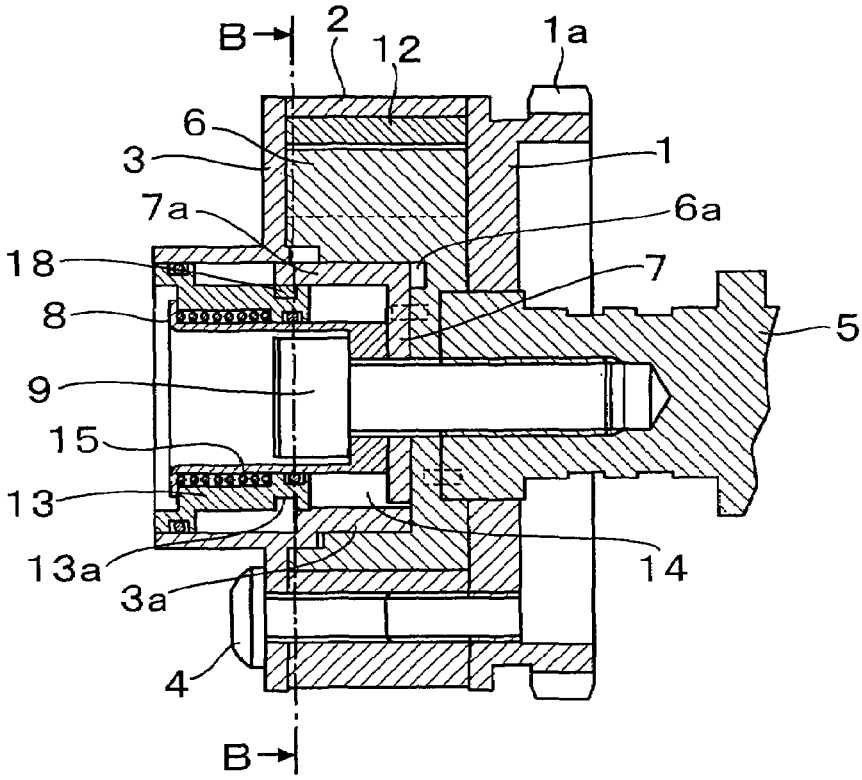
FIG. 1 (A-A section)
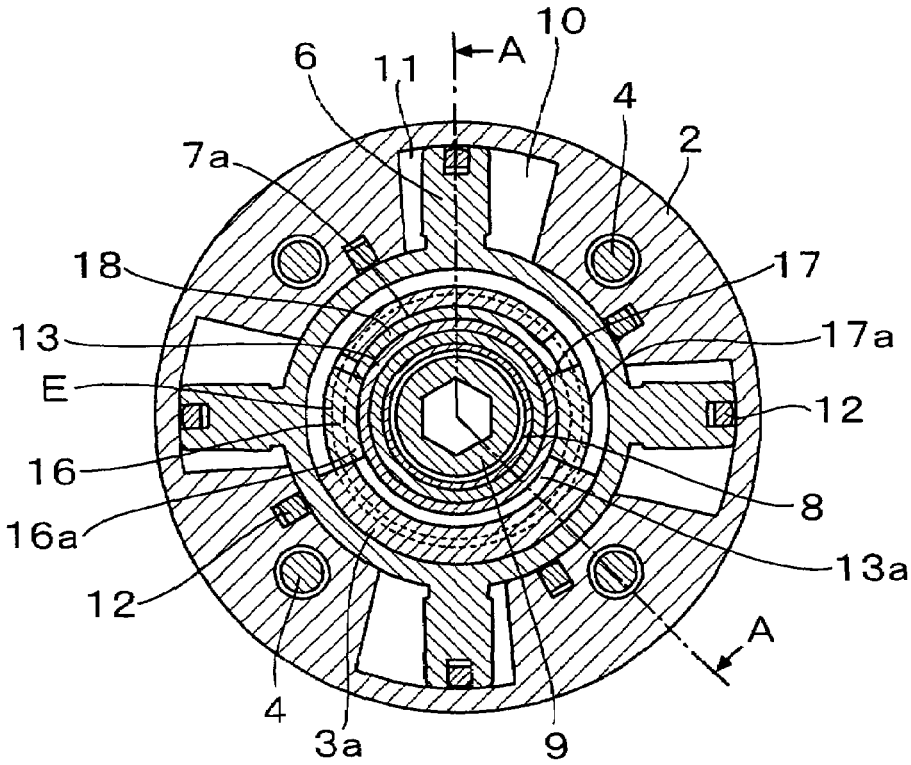
FIG. 2 (B-B section)

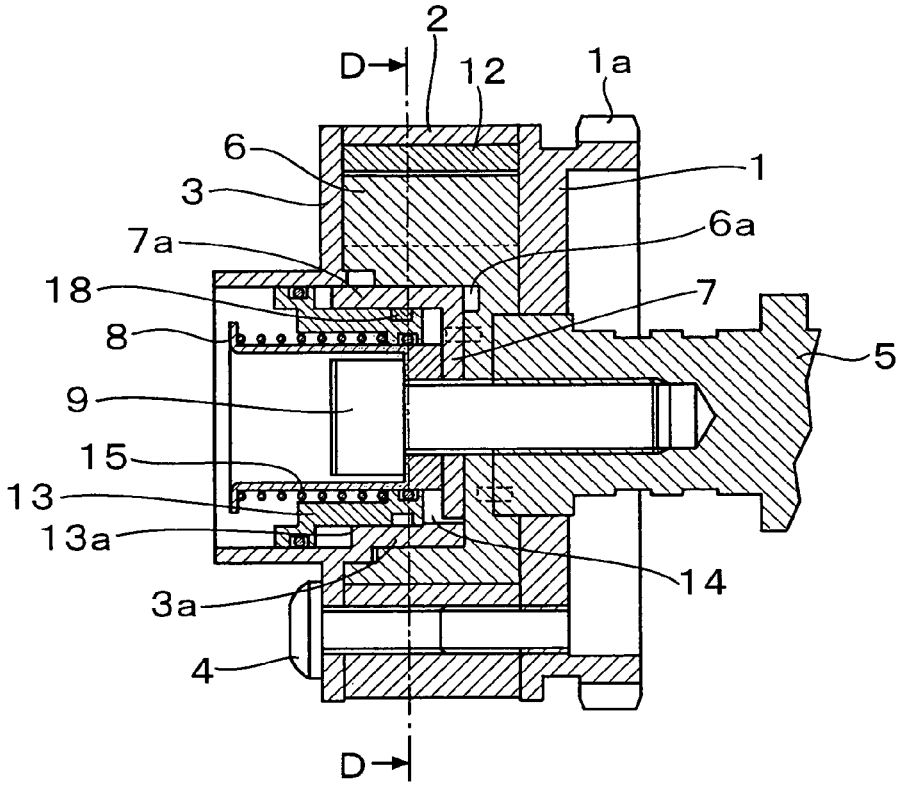
FIG. 3 (C-C section)
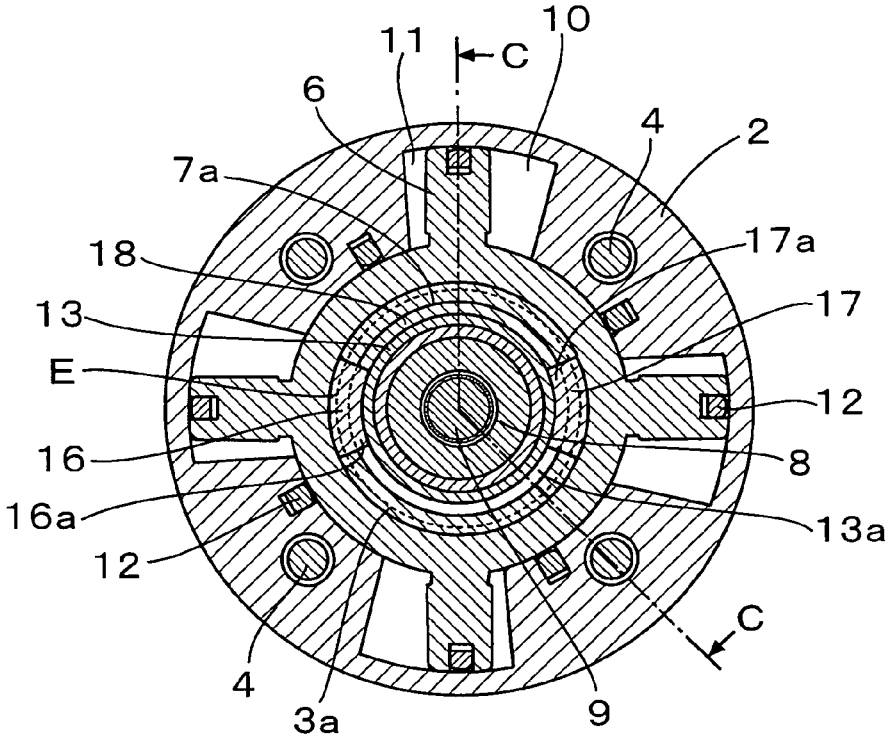
FIG. 4 (D-D section)

(planarly developed section of circumference E)

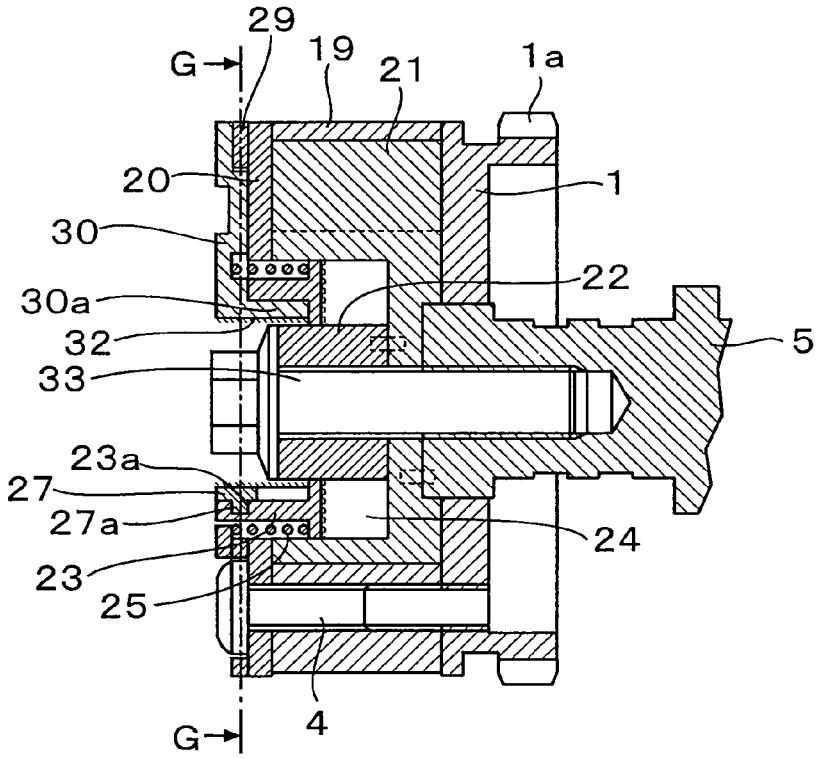
FIG. 6 (F-F section)
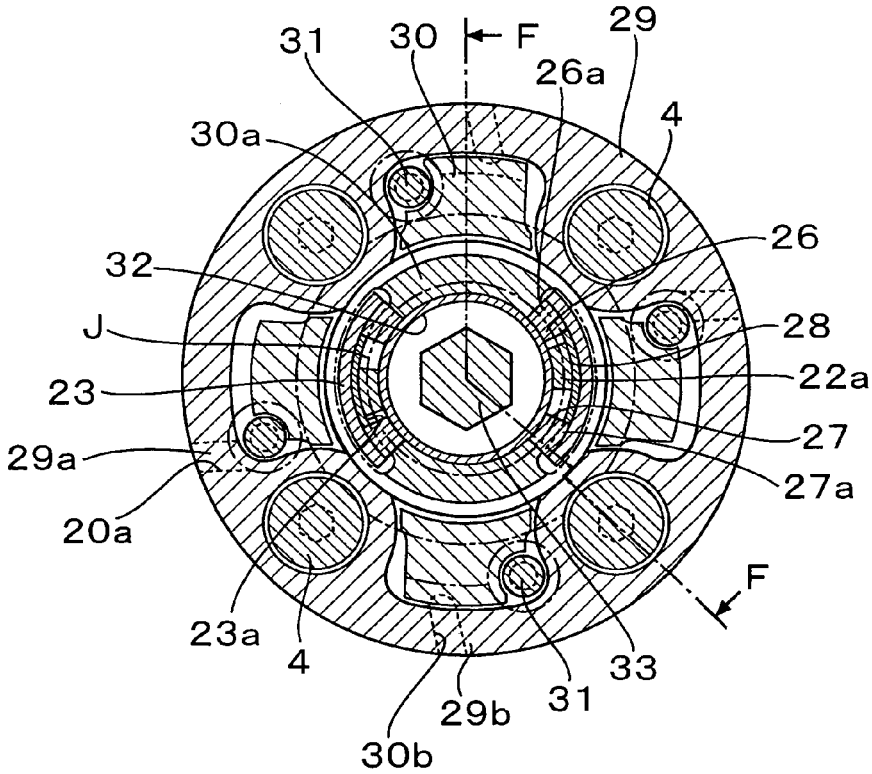
FIG. 7 (G-G section)

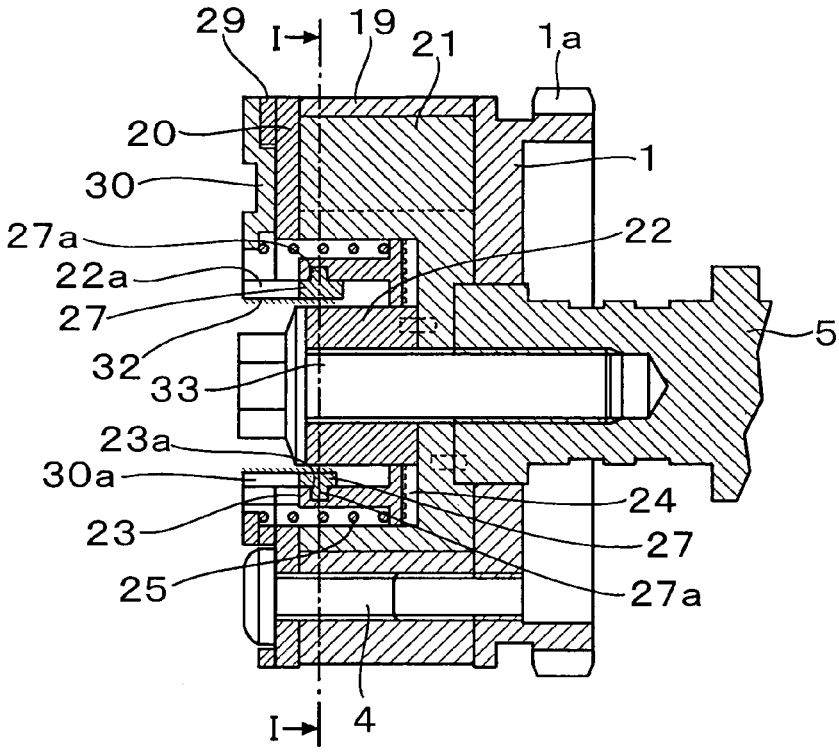
FIG. 8 (H-H section)
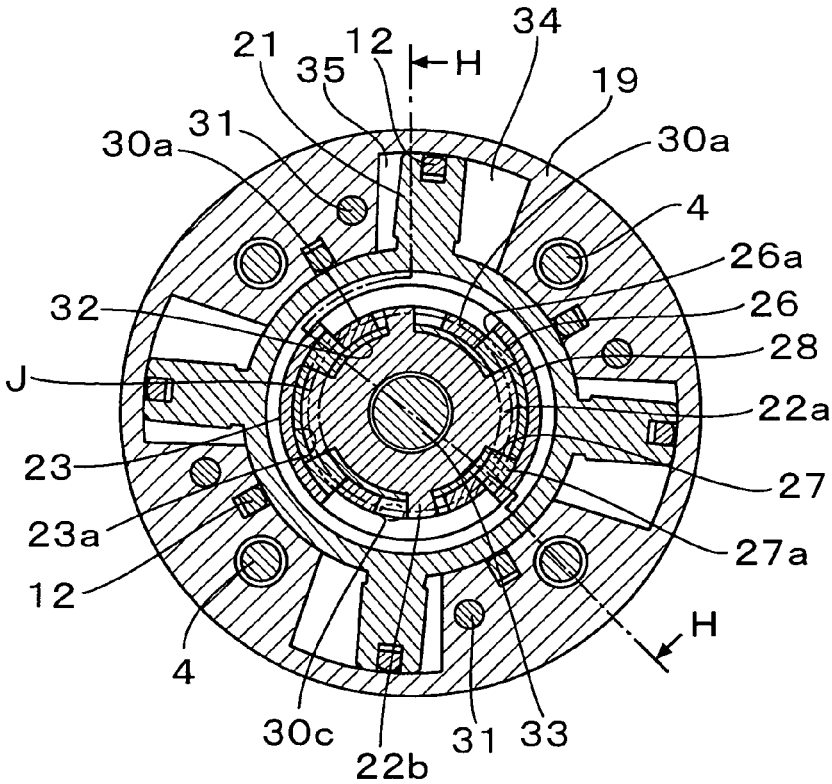
FIG. 9 (I-I section)

(planarly developed section of circumference J)

Valve Timing Controller (VTC)

FIG. 17

Effect of Valve Timing Controller (VTC)

| Effect | Valve Timing | Mechanism |
|---|---|---|
| Hydraulic VTC Valve Timing (Base Position) | Top dead center; Bottom dead center; Discharge; Suction | — |
| a. Improved exhaust in idling after starting | Discharge; Suction | • Re-burning of unburnt HC by early opening of intake valve<br>• Promotion of fuel vaporization by overlapping of intake/exhaust valves |
| b. Improved fuel economy in idling | Discharge; Suction | • Decrease of pumping loss by delayed closing of intake valve |
| c. Increase of output in high load (in low-speed operation) | Discharge; Suction | • Improvement of volumetric efficiency by closing of intake valve near the maximum volume |
| c. Increase of output in high load (in high-speed operation) | Discharge; Suction | • Improvement of volumetric efficiency by delayed closing of intake valve (inertia supercharging) |

PHASE CONTROLLER AND CAM SHAFT PHASE CONTROLLER FOR INTERNAL COMBUSTION ENGINE

BACKGROUND OF THE INVENTION

1. Field of the Invention

The present invention relates to a phase angle controller for controlling a phase angle between two rotary members. Particularly, the present invention is concerned with a phase changing device having a wide control range for realizing an optimum control position in a valve timing controller (hereinafter referred to as "VTC") for an internal combustion engine which device makes variable an opening/closing timing of an intake valve or an exhaust valve actuated by an crank shaft through a cam shaft.

2. Description of the Related Art

First, a VTC used in an automobile engine will be outlined with reference to FIG. 16. In a four-stroke engine, sprockets mounted on front ends of cam shafts for intake and exhaust are rotated through a timing belt with rotation of a crank shaft. At this time, the cam shaft speed is reduced by half in accordance with a gear ratio. A VTC is mounted between each cam shaft and the associated sprocket to change a relative rotational position between the two. The VTC has a function of changing a rotational phase of the cam shaft relative to the crank shaft and thereby change the opening/closing timing of an intake or exhaust valve.

Functions or effects attained by each VTC described above will be explained below with reference to FIG. 17. In FIG. 17 there are shown effects obtained by changing the opening/closing phase of the intake valve in accordance with various operating conditions with use of the intake-side VTC.

In FIG. 17, "a." shows an optimum intake valve opening/closing phase in an idling condition just after starting of an engine. By shifting the intake valve timing to an advance side relative to a top-stage base position in FIG. 17, the intake valve is opened quickly and residual unburned HC (hydrocarbon) gas is introduced and re-burned. Moreover, by setting long an overlapping period between the exhaust stroke and the intake stroke to promote the vaporization of newly supplied fuel, it is possible to decrease the amount of HC contained in the exhaust gas.

In FIG. 17, "b." shows an optimum intake valve opening/closing phase in an idling condition after the end of warming-up. In this case, by shifting the intake valve timing to a delay side relative to the base position, it is possible to delay the close timing of the intake valve and thereby decrease the amount of intake air. Therefore, by throttling a throttle valve it is possible to suppress a pump loss and decrease the amount of fuel consumed.

In FIG. 17, "c." shows intake valve opening/closing phases optimum for increasing the engine torque in a high load condition. As to increasing the engine torque, the way of using VTC is different between the case where the engine is operating at low speed and the case where the engine is operating at high speed. In a low-speed operation of the engine, the amount of intake air becomes maximum when the intake valve is closed in the vicinity of a bottom dead center position of a piston in which a geometric volume within a cylinder becomes maximum, and therefore the phase is shifted to the advance side relative to the base position. In a high-speed operation of the engine, since the amount of intake air is to be increased by utilizing an inertial supercharging effect, the phase is shifted to the delay side relative to the base position to delay the close timing of the intake valve. Thus, the way of use of the VTC differs depending on the engine speed, but the mass of intake air can be increased at any rotational speed by the VTC, thus making combustion of a larger amount of fuel possible and thereby permitting an increase of the engine torque.

In various operating conditions of the valve timing controller, in both idling of "b." and high-speed operation of "c.", the intake valve timing is shifted to the delay side relative to the base position in the top stage to attain the effects shown in FIG. 17. It can be said that the base position is a fixed valve timing of an engine not equipped with VTC. In this case, it is also a valve timing able to start the engine. Therefore, in a conventional intake VTC wherein a locked position at the time of starting is a most delayed position in a control range, the base position lies near the most delayed position and it is impossible to make a further phase conversion to the delay side.

Further, locking the VTC irrespective of position thereof at the time of start-up of the engine has heretofore been required because the VTC is unstable until ensuring a predetermined oil pressure after engine starting and there is a possibility that a beating noise may occur due to vibration or collision.

In view of this point there has heretofore been proposed an intermediate position locking mechanism in a VTC wherein a locked position in engine starting is set at an intermediate position (see, for example, Japanese Patent Laid-Open Publication No. 2001-241307). This intermediate position locking mechanism is based on the way of thinking that in connection with locking to the intermediate position by a vane-induced oil pressure, a stopper portion is formed only at the time of engine stop and starting during automatic return from an advance side to a most delayed position and a locking mechanism such as a locking pin is operated while the VTC is held temporarily on the stopper portion. In Japanese Patent Laid-Open Publication No. Hei 11(1999)-343819 is proposed an intermediate position locking mechanism wherein an automatic return to an intermediate locking position is to be made from not only an advance side but also a delay side.

SUMMARY OF THE INVENTION

However, in the related art, including Japanese Patent Laid-Open Publication No. 2001-241307 and Japanese Patent Laid-Open Publication No. Hei 11(1999)-343819, the following problems are mentioned as technical problems to be addressed for implementing an intermediate position locking mechanism in a hydraulic VTC: (1) a problem related to a driving force up to a locking position and (2) a problem related to the presence of a varying torque.

(1) A description will now be given about a driving force up to a locking position. It is necessary that the VTC be locked in the locking position at the time of starting an engine. During stop and during cracking from the last-time engine stop, the phase must be shifted from the VTC phase in the last-time engine stop up to the locking position. In this period, an intrinsic driving force (an oil pressure in hydraulic drive or an electromagnetic force in electromagnetic drive) of VTC is not obtained (a driving force by the engine is not obtained) and therefore the VTC must ensure for itself a driving force acting toward the locking position for example by utilizing a spring force or a frictional resistance.

Further, in case of locking to the intermediate position, there can be a case where the phase shifting direction at the time of return of VTC for itself to the locking position is not limited to a delay direction but is an advance direction, depending on VTC phase in the last-time engine stop. A varying torque acts on a cam shaft by virtue of a reaction force provided from a valve spring, but a mean value thereof always takes a value in a delay direction due to a frictional resistance on a bearing or cam surface. It is possible to rely on this frictional resistance torque if the direction of return to the locking position is one delay direction, but this driving force is not sufficient as a driving force in an advance direction in addition to the delay direction. It is newly required to ensure a driving force for shifting phase in both directions.

(2) A description will now be given about the presence of a varying torque. For locking to the intermediate position, the VTC returns to the locking position for itself, so if it suffices to generate only a self-effort driving force in both delay and advance directions although it is necessary to provide a driving force in an advance direction in addition to that in a delay direction, all that is required to combining two springs different in the direction of force. However, a varying torque based on a reaction force from a valve spring acts on a cam shaft and this makes the problem in question complicated. A self-effort returning position depends on the balance of a total moment including the varying torque acting on the cam shaft in addition to two spring forces (more exactly, torques generated by the spring forces) and therefore a balanced position is sure to vary.

The variation of torque acting on the cam shaft gives rise to the problem that in case of adopting a VTC phase locking means using a locking pin, if a locking pin—hole fitting gap is made too small, the fitting of the two becomes difficult, while if the gap is made too large, beating noise and damage are apt to occur due to looseness.

If the locking pin and the fitting hole are formed in a tapered shape, it seems possible to address the above problem that the fitting is difficult, but the pin axis and the hole axis cannot be made completely coincident with each other due to errors in parts dimensions and assembly (particularly it is impossible to make a radial deviation zero). Thus, the problem of beating noise remains to be addressed. Moreover, the tapered shape causes a component of a force to be created in a direction to release the locking pin, with a consequent fear of occurrence of a new problem that the reliability of the locking function is impaired.

As set forth above, in such a conventional technique as disclosed in Japanese Patent Laid-Open Publication No. 2001-241307, consideration is given to neither the subject that a driving force for phase shift in both delay and advance directions is to be ensured nor the subject that a rocking motion caused by a varying torque acting on a cam shaft due to a reaction force from a valve spring and looseness caused by a locking pin. Further, the structure disclosed in Japanese Patent Laid-Open Publication No. Hei 11(1999)-343819 cannot guarantee an automatic return to the intermediate locking position from both advance and delay directions.

Accordingly, in the present invention, with a view to enabling a phase control over a wide range by locking to an intermediate position at the time of starting of an engine, it is a first subject how a driving force for self-effort return in both delay and advance directions is to be ensured during a period in which an external VTC driving force cannot be expected such as during engine stop or during cranking. It is a second subject how a phase angle is to be locked positively without the occurrence of vibration and noise caused by for example looseness under the action of a varying torque acting on a cam shaft. It is a third subject how the locked state in the intermediate position is to be released at the time of performing an ordinary moving angle control.

For addressing the above-mentioned problems, the present invention mainly adopts the following constructions.

In one aspect of the present invention there is provided a phase controller having a first rotating member and a second rotating member adapted to be rotated through the first rotating member and controlling a phase angle as a relative rotational position between the first and second rotating members, the phase controller including: a first guide portion mounted unrotatably relative to the first rotating member and occupying a part on a circumference at a certain radial position; a second guide portion mounted unrotatably relative to the second rotating member and arranged alternately with the first guide portion in the direction of a circumference at the same radial position as the certain radial position; a first wedge member disposed between the first and second guide portions in one circumferential direction of the first guide portion on the circumference; a second wedge member disposed between the first and second guide portions in the other circumferential direction of the first guide portion; urging means for urging the first and second wedge members to move in one axial direction simultaneously; and drive means for moving the first and second wedge members in an opposite axial direction, wherein the first and second wedge members are moved in the one axial direction into close contact with both the first and second guide portions by the urging means.

In the above phase controller, the first and second guide portions each have a shape such that a circumferential gap between both guide portions becomes smaller in the one axial direction, and the first and second wedge members disposed within the circumferential gap also each have a shape such that the circumferential size decreases in the one axial direction.

In another aspect of the present invention there is provided a valve timing controller for an internal combustion engine, including: a first rotating member to which a rotating force is transmitted from a crank shaft; a second rotating member configured to transmit a rotating force to a cam shaft; a phase shifting mechanism mounted so as to straddle the first and second rotating members and shifting a relative rotation phase of the cam shaft with respect to the crank shaft in accordance with the state of the internal combustion engine; contact/decontact portions adapted to move relatively in directions in which respective surfaces come into contact with or separate from each other in accordance with the shifting of the phase performed by the phase shifting mechanism, the distance between the surfaces varying in the axial direction of the first and second rotating members; a restraint member disposed so as to be movable between the surfaces of the contact/decontact portions and adapted to restrain the phase of the phase shifting mechanism at a predetermined position in a contacted state with the surfaces of the contact/decontact portions upon movement in one axial direction of the first and second rotating members and become spaced from at least one of the surfaces of the contact/decontact portions to release the phase-restrained state of the phase shifting mechanism upon movement in the other axial direction; and a restraint control mechanism configured to cause the restraint member to move in accordance with the state of the internal combustion engine, wherein the restraint member is disposed so as to be positioned between the surfaces of the contact/decontact portions even in the phase-restraint released state of the phase shifting mechanism.

According to the present invention, for ensuring not only the effect of phase conversion to an advance side but also the effect of phase conversion to a delay side, the locking position at the time of engine starting is set to an intermediate position in a control range, whereby it is possible to attain both the improvement of fuel economy in idling and an increase of torque in high-speed operation.

BRIEF DESCRIPTION OF THE DRAWINGS

FIG. 1 is a sectional side view in an intermediate position unlocked state of a phase controller according to a first embodiment of the present invention, corresponding to a sectional view taken on line A-A in FIG. 2;

FIG. 2 is a cross sectional view taken on line B-B in FIG. 1;

FIG. 3 is a sectional side view in an intermediate position locked state of the phase controller of the first embodiment, corresponding to a sectional view taken on line C-C in FIG. 4;

FIG. 4 is a cross sectional view taken on line D-D in FIG. 3;

FIG. 6 is a sectional side view in an intermediate position unlocked state of a phase controller according to a second embodiment of the present invention, corresponding to a sectional view taken on line F-F in FIG. 7;

FIG. 7 is a cross sectional view taken on line G-G in FIG. 6;

FIG. 8 is a sectional side view in an intermediate position locked state of the phase controller of the second embodiment, corresponding to a sectional view taken on line H-H in FIG. 9;

FIG. 9 is a cross sectional view taken on line I-I in FIG. 8;

FIG. 17 illustrates functions and effects attained by the conventional valve timing controller.

DESCRIPTION OF PREFERRED EMBODIMENTS

First Embodiment

Figure 5E:
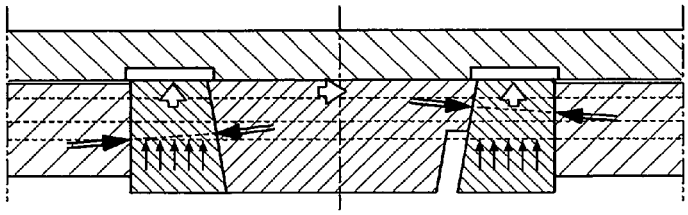
FIG. 5A to FIG. 5E comprise planarly developed sectional views of a circumference E in FIG. 2 or FIG. 4, illustrating intermediate position locking operations.

A phase controller (a cam shaft phase controller for an internal combustion engine as an example) having an intermediate position locking function according to a first embodiment of the present invention will be described in detail below with reference to FIGS. 1 to 5E. FIG. 1 is a sectional side view in an intermediate position unlocked state of a phase controller according to a first embodiment of the present invention, corresponding to a sectional view taken on line A-A in FIG. 2. FIG. 2 is a cross sectional view taken on line B-B in FIG. 1. FIG. 3 is a sectional side view in an intermediate position locked state of the phase controller of the first embodiment, corresponding to a sectional view taken on line C-C in FIG. 4. FIG. 4 is a cross sectional view taken on line D-D in FIG. 3. FIG. 5A to FIG. 5E comprise planarly developed sectional views of a circumference E in FIG. 2 or FIG. 4, illustrating intermediate position locking operations.

In FIG. 1 to FIG. 5E, a sprocket 1 as a first rotating member is reduced by half in speed through a toothed belt (not shown) which is mesh with teeth la formed on an outer periphery of the sprocket, and is rotated by a crank shaft of an engine. A body 2 and a front plate 3 are integrally fixed to the sprocket 1 with assembling bolts 4. A vane 6 as a second rotating member, a slant guide 7 and a spring holder 8 are fixed to a cam shaft 5 with a center bolt 9. As shown in FIGS. 2 and 4, four pairs of delay oil chambers 10 and advance oil chambers 11 are formed between the body 2 and the vane 6. Openings at both axial ends are closed with the sprocket 1 and the front plate 3 and radial gaps are sealed with apex seals 12 to provide a sealed space.

In an intermediate position unlocked state shown in FIGS. 1 and 2, hydraulic oil is introduced from an oil supply pump (neither the oil supply pump nor a hydraulic oil path is shown) into a release oil chamber 14 which is enclosed by the front plate 3, vane 6, spring holder 8 and a release piston 13, the oil supply pump being driven by the engine. The release piston 13 is in a pushed-out state to a maximum extent to a front side (leftwards in FIG. 1) against the force of a locking spring 15. The release piston 13 is in abutment against the spring holder 8 (a left edge portion of the spring holder in the example shown in FIG. 1), whereby a maximum displacement thereof to the front side is inhibited. A groove 13*a* is formed in the release piston 13 and a groove fitting portion 16*a* of a wedge member (1) 16 and a groove fitting portion 17*a* of a wedge member (2) 17 are fitted in the groove 13*a* (in the release piston 13, projected portions as the groove fitting portions 16*a* and 17*a* of the wedge members 16 and 17 are fitted in a recessed portion as the groove 13*a*). These wedge members are also pushed out to the front side. That is, with an axial movement of the release piston 13, the wedges 16 and 17 shift to the front side or the cam shaft side (see FIG. 5A).

The front plate 3 corresponds to a first guide member and a parallel guide portion 3*a* thereof is disposed in a portion a little smaller than half of the whole of a circumference E, as shown in FIG. 2. Both circumferential ends of the front plate 3 are parallel to the axial direction (perpendicular to the paper surface in the example of FIG. 2), as shown in FIG. 5A. On the other hand, the slant guide 7 corresponds to a second guide member and a slant guide portion 7*a* thereof (a member erected axially from the peripheral edge of a part of the slant guide 7 in the example of FIG. 1) is disposed in a portion a little smaller than half of the circumference E, as part of the remaining portion, in FIG. 2. The slant guide portion 7*a* has a shape such that its width in the circumferential direction decreases toward the front side, as shown in FIG. 5A to FIG. 5E.

In this embodiment, an end in a delay direction of the slant guide portion 7*a* is of a shape having a certain inclination angle in FIG. 5A to FIG. 5E, while an end in an advance direction of the slant guide portion 7*a* is formed with a stepped portion 7*b* whose circumferential width decreases stepwise toward the front side, having a certain inclination angle in the other portion. As a result, in the developed views of FIG. 5A to FIG. 5E, one of two circumferential gaps formed between the parallel guide portion 3*a* and the slant guide portion 7*a* becomes narrower at a certain angle from the front side toward the cam shaft side, while the other gap becomes narrower at a certain angle although it has a stepwise narrowing portion.

The contour of the wedge member (1) 16 and that of the wedge member (2) 17 are respectively provided with portions parallel to both ends of the parallel guide portion 3*a* and portions positioned at both ends of the slant guide portion 7*a* and having an inclination angle in FIG. 5A to FIG. 5E. Therefore, wedge angles resulting from crossing of both such portions on extension lines are equal to the inclination angle at both ends of the slant guide portion 7*a*.

In the intermediate position unlocked state (the state shown in FIGS. 1 and 2), as in FIG. 5A, the wedge member (1) 16 and the wedge member (2) 17 are in a pushed-out state to the front side (leftwards in FIG. 1) by the release piston 13, so that gaps are formed circumferentially between each wedge member and the parallel guide portion 3*a* of the front plate 3, or between the wedge members 16, 17 and the slant guide portion 7*a* of the slant guide 7. Therefore, the body 2 and the vane 6 are in a relatively rotatable state in accordance with the gaps. Particularly, when the wedge members are in their positions shown in FIG. 5A, the slant guide portion 7*a* can largely rotate relatively in the advance direction rather than the delay direction from that position with respect to the parallel guide portion 3*a* because in this embodiment the stepped portion 7*b* is formed at one end in the advance direction of the slant guide portion 7*a*. That is, if the parallel guide portion 3*a* of the front plate 3 is in a temporarily fixed state (unrotatable state), the slant guide portion 7*a* as an integral structure with the vane 6 can be shifted (rotated in the state of FIG. 2) in the delay direction or also in the advance direction in a larger shift quantity.

The body 2 and the vane 6 introduce pressure-increased oil into the delay oil chambers 10 (see FIG. 2 showing an unlocked state) to increase the volume of the chamber and discharge oil from the advance oil chambers 11 to decrease the volume of the chamber, thereby causing a phase conversion to be performed in the delay direction (a delay direction of the rotational phase of the cam shaft). Conversely, by decreasing the volume of the delay oil chambers 10 while increasing the volume of the advance oil chambers 11, it is possible to effect a phase conversion in the advance direction (an advance direction of the rotational phase of the cam shaft). In this way there is formed a conventional vane type phase conversion mechanism using oil pressure. If the release piston 13 is held in the intermediate position unlocking position as in FIG. 1 or FIG. 5A, the phase control of VTC can be performed by the phase conversion mechanism (not shown).

In the intermediate position locked state shown in FIGS. 3 and 4, hydraulic oil is not introduced into the release oil chamber 14 and the release piston 13 is in a pushed state to a pushed-in state to a maximum extent toward an engine body (rightwards in FIG. 3) by the locking spring 15. At this time, the wedge member (1) 16 and the wedge member (2) 17 fitted in the groove 13*a* of the release piston 13 are in close contact with both parallel guide portion 3*a* and slant guide portion 7*a* as in FIG. 5E. That is, in the sectional side view of FIG. 3, the movement of the release piston 13 is not inhibited directly by an axial abutment surface, so that a maximum displacement on the engine body side (rightward in the example shown in FIG. 3) of the release piston 13 is inhibited by a circumferential gap-free arrangement of the wedge member (1) 16, wedge member (2) 17, parallel guide portion 3*a* and slant guide portion 7*a*. In the sectional side view of FIG. 3, relief portions 6*a* are formed in end face portions of the vane 6 opposed to right end faces (corresponding to upper end faces of the wedge members in the example shown in FIG. 5E) of the wedge member (1) 16 and the wedge member (2) 17. Thus, consideration is given so as to avoid first contact of the right end faces of the wedge members with the end face portions of the vane 6, thereby ensuring a circumferential, gap-free, close contact of the members concerned.

In the state shown in FIGS. 3, 4 and FIG. 5E, a relative rotation between the parallel guide portion 3*a* and the slant guide portion 7*a* is impossible, with the result that the VTC is inevitably brought into a locked state. Since the wedge members are pushed in axially by the locking spring 15 until there no longer is any gap in the circumferential direction, there does not occur any noise based on looseness even under the action of a varying torque.

FIGS. 5A to 5E are operation principle diagrams of intermediate position locking, showing an example of a process in which the VTC makes phase conversion into a locked state up to the intermediate locking position for itself during engine stop or cranking for start-up. In the intermediate position locked state of FIG. 5E, if the wedge member (1) 16 and the wedge member (2) 17 are moved leftwards (FIG. 1) by the release piston 13 while leaving the phase relation between the parallel guide 3*a* and the slant guide portion 7*a* intact, the resulting state is as shown in FIG. 5A.

In FIG. 5A, circumferential gaps are formed among the wedge member (1) 16, wedge member (2) 17, parallel guide portion 3*a* and slant guide portion 7*a*, showing an intermediate position unlocked state. However, since the gap located in the advance direction is larger than that located in the delay direction due to the presence of the stepped portion 7*b* formed at one end in the advance direction of the slant guide portion 7*a*, it is seen that the control range of the VTC in the advance direction from the intermediate locking position is wider than that in the delay direction.

In other words, the intermediate locking position is set close to a most delayed position from the center of the entire control range. In this embodiment, a stopper 18 is installed into the groove 13*a* of the release piston 13 at the portion not fitted with the groove fitting portions 16*a* and 17*a* of the wedge members (1) 16 and (2) 17 respectively to inhibit movement of the wedge members 16, 17 in the direction of the stopper 18, thereby preventing separation of the wedge members from the parallel guide portion 3*a*. Particularly, as to the wedge member (2) 17, by maintaining a circumferential position thereof close to the parallel guide portion 3*a*, the wedge member (2) 17 can be spaced from the stepped portion 7*b* of the slant guide portion 7*a*. Therefore, when the wedge member (2) 17 is pushed-in in any of operations subsequent to FIG. 5B, the wedge member (2) 17 can be prevented from being caught in the stepped portion 7*b* and thereby inhibited its movement.

Figure 5D:
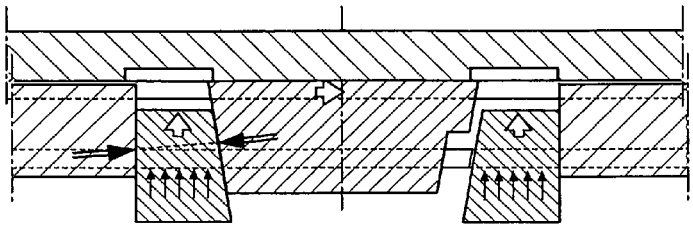
Figure 5C:
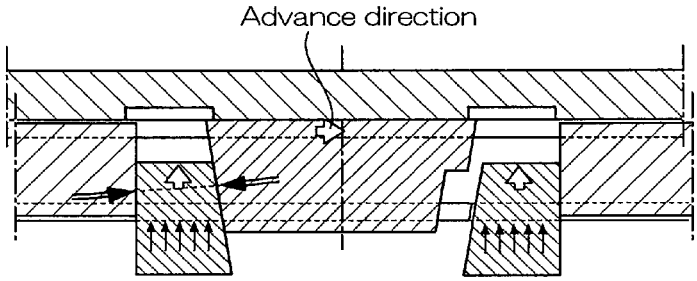
Figure 5B:
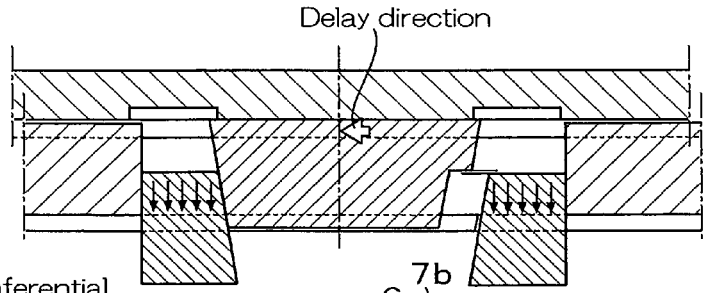
Figure 5A:
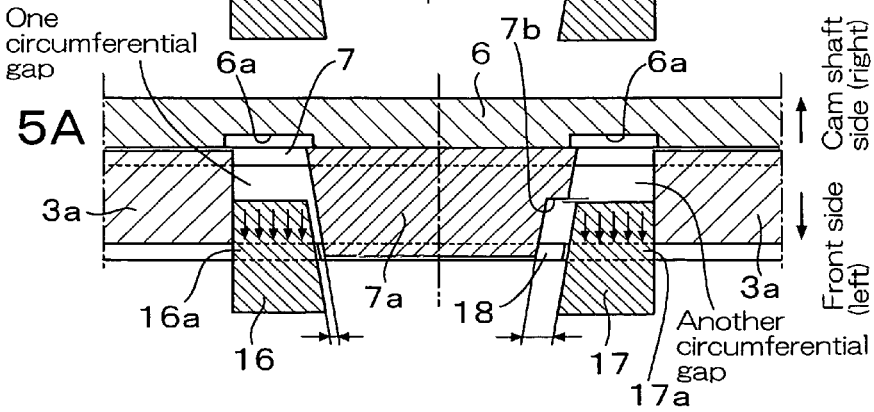

FIG. 5B shows a phase-controlled state to the most delayed position in an intermediate position unlocked condition. In the shifting of phase according to this embodiment, the most delayed position and most advanced position are determined by a relative rotation of the vane 6 into abutment against the body 2 in FIG. 2 or FIG. 4. Therefore, the wedge member (1) 16 in FIG. 5B is not completely sandwiched in between the parallel guide portion 3*a* and the slant guide portion 7*a*, but a slight circumferential gap is present between it and those guide portions. In this state, the force induced by the oil pressure in the release oil chamber 14 surpasses the force of the locking spring and a force acting in the left direction (FIG. 1) is exerted on the release piston 13. The wedge members with their groove fitting portions 16*a*, 17*a* fitted in the groove 13*a* of the release piston 13 maintain their left end positions (lower end positions in the examples of FIG. 5A to FIG. 5E).

FIG. 5C shows a state in which hydraulic oil is not fed to the release oil chamber 14 and a rightward (FIG. 1) force is exerted on the release piston 13 and the wedge members by means of the locking spring 15 during engine stop or at the time of starting of the engine after the stop. As the direction of action of the force exerted on the release piston 13 and the wedge members changes to the right direction (toward the cam shaft in FIG. 5A) from the state of FIG. 5B, those members move rightwards and the slant guide portion 7*a* is somewhat displaced in the advance direction. In the state of FIG. 5B, slight circumferential gaps are present among the members concerned, so it is easily understandable that the release piston 13 and the wedge members move rightwards by the corresponding distance. But the reason why they have moved more in the right direction and the slant guide portion 7*a* displaced in the advance direction is that a varying torque which varies over both positive and negative regions acts on the cam shaft 5.

Even if a positive torque, i.e., torque acting in the delay direction, is exerted on the cam shaft 5 or the slant guide portion 7*a*, since the wedge member (1) 16 is small in wedge angle, a frictional resistance surpasses a component of the circumferential force and the wedge member (1) 16 is not pushed out in the axial direction (leftwards). Therefore, the slant guide portion 7*a* is not returned in the delay direction, either. On the other hand, if a negative torque, i.e., torque acting in the advance direction, is exerted on the slant guide portion 7*a*, the slant guide portion 7*a* performs a phase shift freely in the advance direction because the slant guide portion 7*a* has a gap between it and the wedge member (2) 17 in the advance direction. After all, the slant guide portion 7*a* performs a phase shift in the advance direction intermittently with the cycle of a varying torque.

FIG. 5D shows a state in which the phase shift in the advance direction has further proceeded from the state of FIG. 5C. The mechanism of the phase shift proceeding in the advance direction is just the same as that described above in connection with FIG. 5C. In FIG. 5D, as a result of the wedge member (2) 17 having moved rightwards, its right end portion passed the stepped portion 7*b* of the slant guide portion 7*a* and largely got into the portion where the gap between the slant guide portion 7*a* and the parallel guide portion 3*a* is narrow.

FIG. 5E shows a final intermediate position locked state. Also in FIGS. 5D to 5E, the mechanism of the phase shift proceeding in the advance direction is just the same as that described above in connection with FIG. 5C. In FIG. 5E, the wedge members (1) 16, (2) 17, parallel guide portion 3*a* and slant guide portion 7*a* are in close contact with one another in the circumferential direction without leaving any gap and the phase shift as VTC is locked in a completely looseness-free state.

Usually, a varying torque acting on the cam shaft varies over both positive and negative regions, but a mean value thereof is a positive value, i.e., torque acting in the delay direction. Therefore, under the action of only the varying torque on the cam shaft during engine stop or starting, the average torque in the delay direction permits the VTC to shift phase in the delay direction. When the present phase lies on the advance side with respect to the intermediate locking position, the phase shifting mechanism in the advance direction in FIGS. 5C and 5D becomes a phase shifting mechanism in the delay direction and the VTC can easily shift phase for itself from the advance side toward the intermediate locking position.

The operation principle diagrams of intermediate position locking from FIGS. 5A to 5E show that the VTC can shift phase for itself also in the advance direction from the delay side toward the intermediate locking position. After all, for example during engine starting, the VTC can shift phase into a locked state for itself from any phase toward the intermediate locking position.

In this embodiment, moreover, since the stepped portion 7*b* is formed in the slant guide portion 7*a*, the circumferential gap among the members concerned in FIG. 5A becomes large relative to the amounts of axial movements of the release piston 13 and the wedge members between FIGS. 5A and 5E, it is possible to provide a VTC having a large shift angle in phase angle control within a limited axial size.

Second Embodiment

Figure 10B:
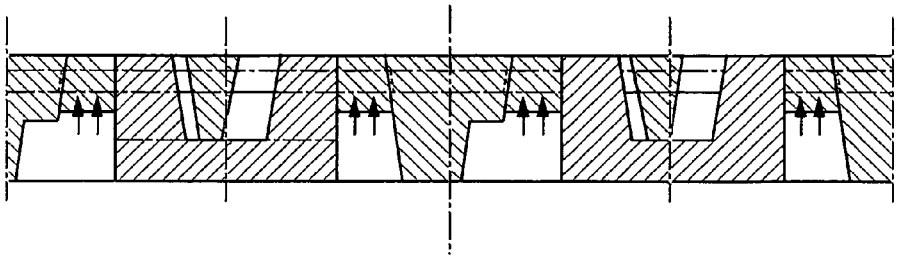
FIG. 10(A) and FIG. 10(B) comprise planarly developed sectional views of a circumference J in FIGS. 7 and 9, illustrating intermediate position locking operations.
Figure 10A:
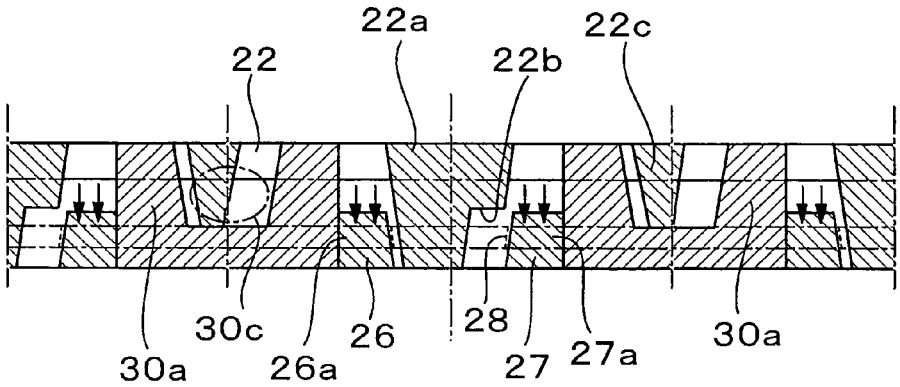

A cam shaft phase controller for an internal combustion engine having an intermediate position locking function according to a second embodiment of the present invention will be described in detail below with reference to FIG. 6 to FIG. 10(B). FIG. 6 is a sectional side view in an intermediate position unlocked state of a phase controller according to a second embodiment of the present invention, corresponding to a sectional view taken on line F-F in FIG. 7. FIG. 7 is a cross sectional view taken on line G-G in FIG. 6. FIG. 8 is a sectional side view in an intermediate position locked state of the phase controller of the second embodiment, corresponding to a sectional view taken on line H-H in FIG. 9. FIG. 9 is a cross sectional view taken on line I-I in FIG. 8. FIG. 10(A) and FIG. 10(B) comprise planarly developed sectional views of a circumference J in FIGS. 7 and 9, illustrating intermediate position locking operations. FIGS. 11, 12, 13, 14, and 15, illustrate a slant guide, a wedge member (3), an Oldham's coupling, a parallel guide, and a thrust guide screw, respectively, which are constituent parts used in the second embodiment.

In this second embodiment, the shapes of body 19, front plate 20, vane 21, slant guide 22, release piston 23, release oil chamber 24, locking spring 25, wedge member (3) 26, wedge member (4) 27, stopper 28 and center bolt 33 are different from those described in the first embodiment. Further, an Oldham's coupling 29 (slightly movable radially and coupled for integral operation in a rotational direction), a parallel guide 30, a thrust guide screw 31 and a sleeve 32 are used as additional members.

Figure 11:
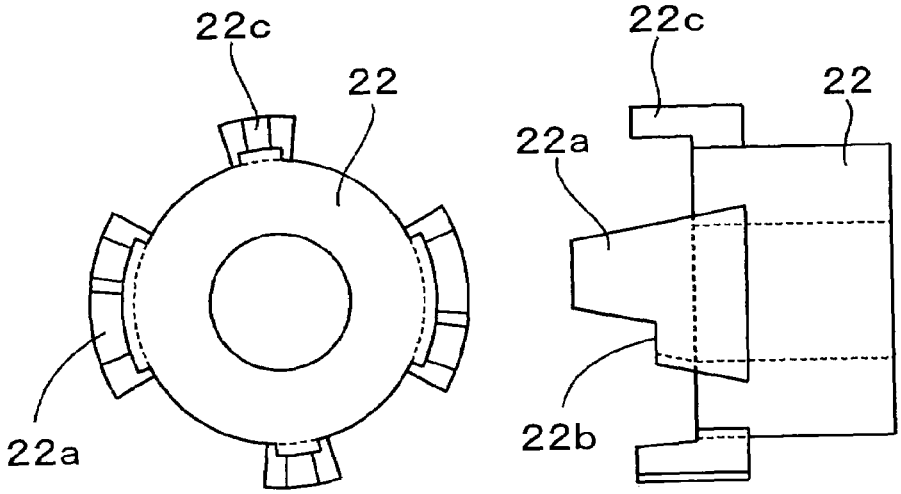
FIG. 11 illustrates the shape of a slant guide alone which is a constituent part used in the second embodiment.
Figure 12:
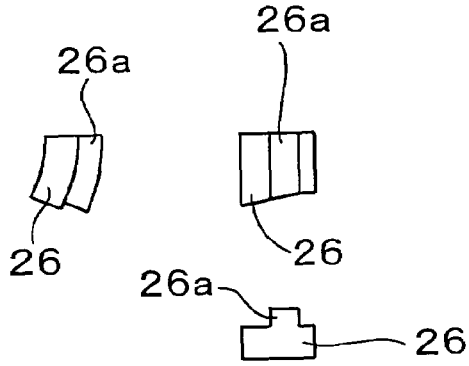
FIG. 12 illustrates the shape of a wedge member (3) alone which is a constituent part used in the second embodiment.
Figure 15:
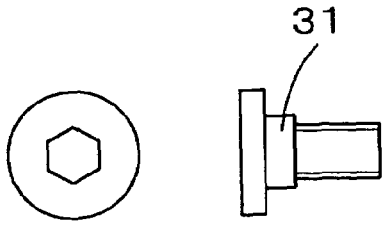
FIG. 15 illustrates the shape of a thrust guide screw alone which is a constituent part used in the second embodiment.
Figure 13:
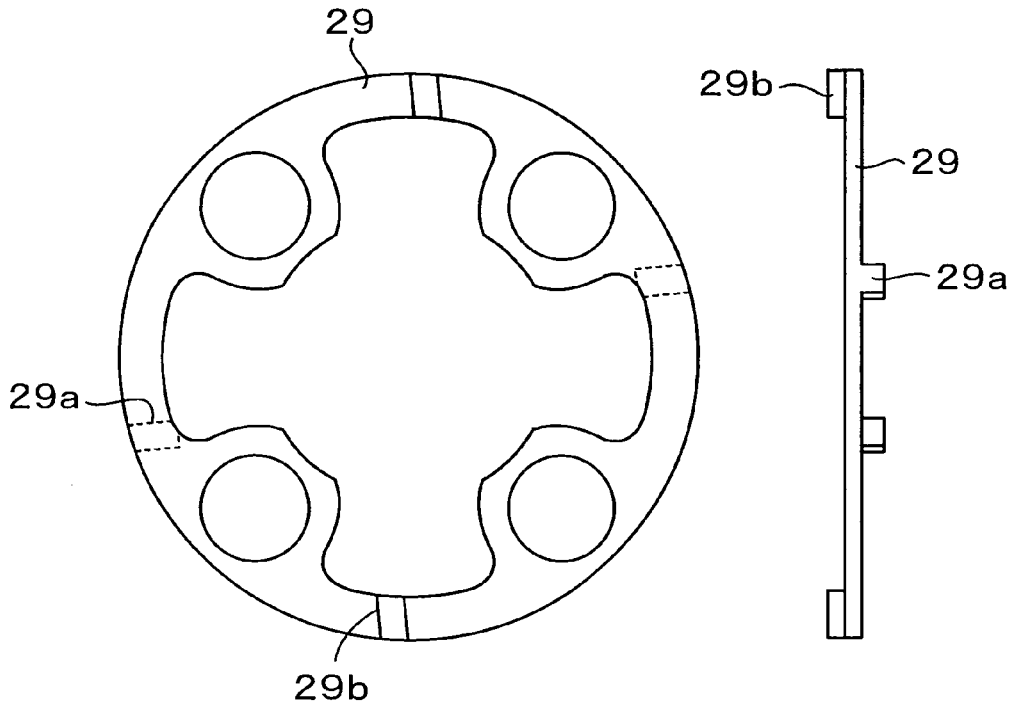
FIG. 13 illustrates the shape of an Oldham's coupling alone which is a constituent part used in the second embodiment.
Figure 14:
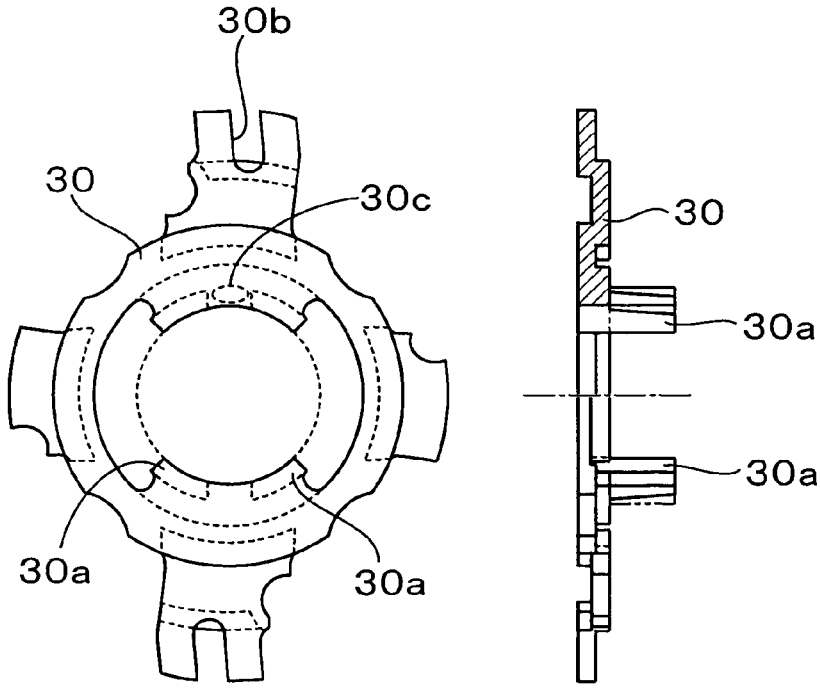
FIG. 14 illustrates the shape of a parallel guide alone which is a constituent part used in the second embodiment.
Figure 16:
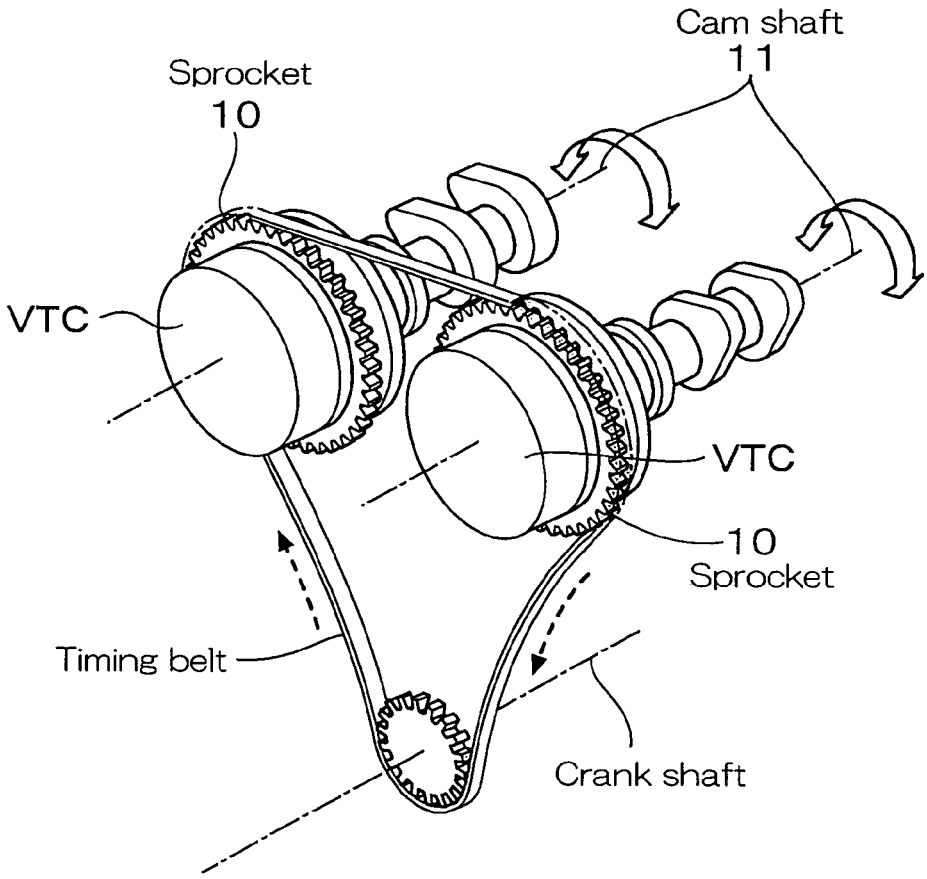
FIG. 16 illustrates an outline of a conventional valve timing controller used in an automobile engine.

In FIG. 11, the slant guide 22 is made up of slant guide portions 22*a*, stepped portions 22*b* and piston support portions 22*c* and has such a structure as illustrated in the same figure. In FIG. 12, the wedge member (3) 26 has a groove fitting portion 26 (adapted to fit in a groove 23*a* of the release piston 23). In FIG. 13, the Oldham's coupling 29 is made up of key portions (1) 29*a* (adapted to fit in key ways 20*a* of the front plate) and key portions (2) 29*b* (adapted to fit in key ways 30*b* of the parallel guide) formed on the opposite side and is disposed in the illustrated manner. In FIG. 14, the parallel guide 30 is made up of parallel guide portions 30*a*, key ways 30*b* (adapted to fit in the key portions (2)) and cut portions 30*c* (confronting the piston support portions) and has such a structure as illustrated in the same figure. FIG. 15 shows the structure of the thrust guide screw 31.

In this second embodiment, the front plate 20 is not formed with a parallel guide portion, but the parallel guide 30 as a separate member is formed with parallel guide portions 30*a* (erected axially from the inner peripheral edge of the parallel guide 30). The parallel guide 30 is connected to the front plate 20 through the Oldham's coupling 29. The two key portions (1) 29*a* of the Oldham's coupling 29 are fitted in the two key ways 20*a* of the front plate 20 and the other two key portions (2) 29*b* are fitted in the two key ways 30*b* of the parallel guide 30. The parallel guide 30 can perform a translational motion in a plane orthogonal to the axis but cannot perform a relative rotation with respect to the front plate 20. The parallel guide 30 and the Oldham's coupling 29 are inhibited from movement to the front side (to this side in FIG. 7) by the head of the thrust guide screw 31 which is threadedly fixed to the body 19 with the front plate 20 therebetween.

The parallel guide portions 30*a* of the parallel guide 30 are alternately arranged circumferentially on the same radius as the radius on which the slant guide portions 22*a* of the slant guide 22 are arranged, the slant guide 22 being fixed to the cam shaft 5 and the vane 21 with the center bolt 33. In this embodiment, as is seen from FIGS. 7, 9 and 10, the parallel guide portion 30*a* and the slant guide portions 22*a* are provided each in two places and four wedge members are mounted so as to be each positioned between adjacent such guide portions in the circumferential direction. More specifically, two wedge members (3) 26 are mounted adjacent the slant guide portions 22*a* in the delay direction and two wedge members (4) 27 are mounted adjacent the slant guide portions 22*a* in the advance direction.

The slant guide portions 22*a* are formed with stepped portions 22*b* for the same purpose as that in the first embodiment. The parallel guide portions 30*a* are respectively provided with cut portions 30*c* nearly centrally in the circumferential direction and the piston support portions 22*c* of the slant guide 22 are disposed respectively in those spaces. The piston support portions 22*c* have a slant contour like that of the slant guide portions 22*a*, but this shape is merely based on a strength-related reason and is not a shape for close contact with the wedge members, unlike the slant guide portions 22*a*.

The function of the piston support portions 22*c* of the slant guide 22 is such that their outer periphery surfaces guide the inner periphery surface of the release piston 23 to stabilize the attitude of the release piston 23 lest the piston should tilt. The outer periphery surface of a sleeve 32 is fixed by press-fitting to the inner periphery surfaces of the parallel guide portions 30*a*, which sleeve 32 is for preventing the wedge members (3) 26 and (4) 27 from falling off to the inner periphery side.

As in the first embodiment, the release piston 23 moves axially between FIGS. 6 and 8 in accordance with presence or absence of a force induced by the oil pressure in the release oil chamber 24. At this time, the wedge members (3) 26 and (4) 27 with their groove fitting portions 26*a*, 27*a* fitted in the groove 23*a* of the release piston 23 also move axially together with the release piston 23, making a state change between the intermediate position unlocked state and the intermediate position locked state. This is the same as in the first embodiment.

A structural feature of this second embodiment is that, as described above, the parallel guide portions 30*a* and the slant guide portions 22*a* are provided each in two places and the wedge members (3) 26, (4) 27 installed therebetween are also provided each two. Consequently, when the VTC is put in the intermediate position locked state (the state of FIGS. 9 and 10(B)) by the above members and when the varying torque on the cam shaft 5 becomes a torque acting in the delay direction, the varying torque is borne by a couple of forces acting between the slant guide portions 22*a* and the parallel guide portions 30*a* through the two wedge members (3) 26 lying in opposed positions on the circumference J (see FIG. 9). When the varying torque on the cam shaft 5 becomes a torque acting in the advance direction, it is borne by a couple of forces acting through the two wedge members (4) 27. Since the arm length in those couples of forces is considered approximately equal to the diameter of the circumference J on the average, the magnitude of the force working on each of the wedge members which constitute the couples of forces is equal to a value obtained by dividing the varying torque on the cam shaft by the diameter of the circumference J.

In contrast therewith, the phase controller of the first embodiment is provided with only one parallel guide portion 3*a* and one slant guide portion 7*a* and the torque in the delay or advance direction is borne by a couple of forces constituted by a working force in either the wedge member (1) 16 or the wedge member (2) 17 and a working force present in a turning pair center between the parallel guide portion 3*a* and the slant guide portion 7*a*, i.e., near the central axis. The arm length in this couple of forces corresponds to the radium of the circumference E on the average and the magnitude of each of the working forces which constitute the couple of forces is a value obtained by dividing the varying torque on the cam shaft 5 by the radius of the circumference E (see FIG. 4). It is apparent that, for the same varying torque value, the circumferential force acting on each wedge member is smaller in the second embodiment insofar as the size of the circumference E and that of the circumference J do not change to the extreme degree. That is, according to the second embodiment, it is possible to decrease the surface pressure in each wedge member and improve the reliability.

In the second embodiment, since the parallel guide 30 formed with the parallel guide portions 30*a* is mounted through the Oldham's coupling 29, it can perform a translational motion in a plane orthogonal to the axis with respect to the front plate 20. Therefore, in the case where the magnitudes of working forces at two places acting on the parallel guide portions 30*a* through the two opposed wedge members differ due to a change of torque on the cam shaft 5 at the time of intermediate position locking and the couple of forces is not a complete couple of forces, the forces acting on the parallel guide 30 cannot be cancelled each other and, with the remaining force acting in the translational direction, the parallel guide 30 performs a translational motion in a plane orthogonal to the axis.

This motion decreases the larger one of the two working forces and increases the smaller one, so that the parallel guide 30 becomes stable at a place where both working forces coincide with each other. That is, according to this structure, the working forces in two opposed wedge members are sure to become approximately equal to each other, so that it is possible to level the surface pressures of the wedge members, thereby prevent a partial occurrence of a large surface pressure and improve the reliability.

The features of the phase controllers embodying the present invention and described above will now be described again with use of a constructional example of application to a valve timing controller (VTC) for an internal combustion engine. First, there are provided a first rotating member 3 (integral with the sprocket 1 and the body 2) which is rotated in synchronism with the engine crank shaft and a second rotating member 6 (integral with the slant guide 7) adapted to be rotated through the first rotating member 3 and connected integrally with the cam shaft. A first guide member 3*a* is mounted unrotatably to the first rotating member 3 and is positioned so as to occupy a part on the circumference at a certain radial position. A second guide member 7*a* is mounted unrotatably to the second rotating member 6 and is positioned so as to be circumferentially alternate with the first guide portion 3*a* at the same radial position. A wedge member (1) 16 is disposed between the first guide portion 3*a* and the second guide portion 7*a* on the aforesaid circumference and in one circumferential direction of the first guide portion 3*a*, while a wedge member (2) 17 is disposed between the first guide portion 3*a* and the second guide portion 7*a* in the opposite circumferential direction of the first guide portion 3*a*.

Further provided are urging means 15 using a spring or the like for moving the wedge members (1) 16 and (2) 17 in one axial direction simultaneously and drive means 13 using a hydraulic piston or the like for moving the wedge members (1) 16 and (2) 17 in an opposite axial direction. In this case, the shapes of the constituent members are such that the wedge members (1) 16 and (2) 17 can each be axially moved by the urging means 15 into close contact with both first and second guide portions 3*a*, 7*a*. In this VTC to which the present invention is applied, a phase shifting mechanism (not shown) for changing the phase of the first and second rotating members 3, 6 relative to each other in a normal state of control after engine starting is also installed separately from the above construction.

Consequently, according to the above embodiments of the present invention, during engine stop or cranking in re-starting in which the phase shifting mechanism does not function and the wedge members 16 and 17 are trying to move in one axial direction under the action of the urging means 15, a driving force advancing toward the locking position lying intermediate in the phase shifting range can be produced from any position. In the above state, the wedge members (1) 16 and (2) 17 are not yet in close contact with the first and second guide portions 3*a*, 7*a*, and the first rotating member 3 (integral with the sprocket 1) and the second rotating member 6 (integral with the cam shaft 5) with the first and second guide portions 3*a*, 7*a* attached thereto respectively rotate relatively with respect to each other and can effect phase shifting.

At this time, a varying torque which varies over both positive and negative regions is exerted on the cam shaft 5 under a reaction force provided from the valve spring, so that the first and second rotating members 3, 6 tend to perform a pivotal motion about a central axis relatively with respect to each other. As a result, the first and second guide portions 3*a*, 7*a* assume a state in which they sandwich the wedge member (1) 16 or the wedge member (2) 17 in between them under the action of the varying torque provided from the cam shaft 5. However, with respect to both wedge members (1) 16 and (2) 17, the wedge angle (an angle formed by tangential lines in the contacted portion of both first and second guide portions 3*a*, 7*a* when the wedge members are developed into a two-dimensional plane from their arranged state on the radius) is set sufficiently small. Therefore, the force of the wedge member 16 (17) being pushed back in the axial direction opposite to the urging means 15 under the sandwiching force of the first and second guide portions 3*a*, 7*a* is cancelled by a frictional resistance. This is also true of the case where the direction of the varying torque reverses and the other wedge member is sandwiched in between the first and second guide portions.

On the other hand, the varying torque from the cam shaft 5 repeats the state in which the absolute value thereof is sure to approach zero in the course of varying over both positive and negative regions. When the wedge member (1) 16 and the wedge member (2) 17 are not yet in close contact with the first and second guide portions 3*a*, 7*a*, there surely occurs a state in which one of the wedge members is not sandwiched in between both guide portions the moment the wedge member to be sandwiched in between both guide portions changes. In this state, a contact force or a frictional force between each wedge member and each guide portion acts on neither the wedge member (1) 16 nor the wedge member (2) 17, so that the wedge members are sure to be moved in the direction of close contact with the guide portions by the urging means 15.

That is, the wedge members (1) 16 and (2) 17 are moved intermittently in one axial direction by the urging means 15 without being returned in the opposite direction and are sure to move up to the position where they come into close contact with both first and second guide portions 3*a*, 7*a*. If the wedge members (1) 16 and (2) 17 move axially and simultaneously, it is only when the first rotating member 3 and the second rotating member 6 are in a predetermined phase relation that they can come into close contact with both first and second guide portions 3*a*, 7*a*. By setting the phase to the intermediate position locking phase the VTC can return to the locking position for itself by utilizing the varying torque on the cam shaft 5 in the delay direction or in the advance direction. Once the VTC occupies this position, the wedge members 16 and 17 are never pushed back in the opposite axial direction, so that there is maintained a locked state as a closely contacted, looseness-free state in which the wedge members are in close contact with both first and second guide portions 3*a*, 7*a*.

When sufficient hydraulic oil is fed from the oil supply pump after starting of the engine, the drive means using a hydraulic piston for example operates to move the wedge members (1) 16 and (2) 17 in the opposite axial direction, thereby releasing the locked state in which the wedge members 16, 17 and the first and second guide portions 3*a*, 7*a* are in close contact/non-contact with each other. This released state is a state in which the members inhibiting the relative rotation between the first rotating member 3 and the second rotating member 6 have been removed. Therefore, the phase shifting control in normal condition can be performed using the conventional phase shifting mechanism installed separately from the construction of the present invention.

What is claimed is:

1. A phase controller having a first rotating member and a second rotating member adapted to be rotated through the first rotating member and controlling a phase angle as a relative rotational position between the first and second rotating members, the phase controller comprising:

a first guide portion mounted so as to be relatively unrotatable to an upstream-side member in a power transfer path from the first rotating member to the second rotating member and a second guide portion mounted so as to be relatively unrotatable to a downstream-side member in the power transfer path, the first guide portion and the second guide portion being arranged alternately in the direction of a circumference at the same radial position;

a first wedge member disposed between the first guide portion and the second guide portion in one circumferential direction of the first guide portion on the circumference and a second wedge member disposed between the first guide portion and the second guide portion in the other circumferential direction; and urging means that urge the first wedge member and the second wedge member in one axial direction simultaneously and drive means that move the first wedge member and the second wedge member in an opposite axial direction, wherein the first wedge member and the second wedge member are moved in the one axial direction by the urging means and the wedge members come into close contact with both the first and second guide portions in the one circumferential direction and in the other circumferential direction.

2. A phase controller according to claim 1, wherein the first and second guide portions each have a shape such that a circumferential gap between both the guide portions becomes smaller in the one axial direction, and the first and second wedge members disposed within the circumferential gap also each have a shape such that the circumferential size decreases in the one axial direction.

3. A phase controller according to claim 2, wherein the drive means that move the first and second wedge members in the opposite axial direction utilizes oil pressure as the driving force.

4. A phase controller according to claim 2, further comprising a plurality of oil chambers whose volumes increase or decrease in directions opposite to each other in interlock with a phase change between the first and second rotating members, the phase change being performed by controlling the feed and discharge of hydraulic oil to and from each of the oil chambers in a state in which the first and second wedge members are moved in the opposite axial direction by the drive means.

5. A phase controller according to claim 2, wherein the first and second wedge members comprise two or more pairs of first and second wedge members, and the first and second guide portions also comprise two or more pairs of first and second guide portions.

6. A phase controller according to claim 1, wherein the drive means that move the first and second wedge members in the opposite axial direction utilizes oil pressure as the driving force.

7. A phase controller according to claim 6, further comprising a plurality of oil chambers whose volumes increase or decrease in directions opposite to each other in interlock with a phase change between the first and second rotating members, the phase change being performed by controlling the feed and discharge of hydraulic oil to and from each of the oil chambers in a state in which the first and second wedge members are moved in the opposite axial direction by the drive means.

8. A phase controller according to claim 1, further comprising a plurality of oil chambers whose volumes increase or decrease in directions opposite to each other in interlock with a phase change between the first and second rotating members, the phase change being performed by controlling the feed and discharge of hydraulic oil to and from each of the oil chambers in a state in which the first and second wedge members are moved in the opposite axial direction by the drive means.

9. A phase controller according to claim 1, wherein the first and second wedge members comprise two or more pairs of first and second wedge members, and the first and second guide portions also comprise two or more pairs of first and second guide portions.

10. A phase controller according to claim 9, wherein the two or more pairs of the first and second guide portions perform a relative, translational motion in a plane orthogonal to the axial direction.

11. A phase controller according to claim 1, wherein a cutout portion is formed in at least one of the first guide portion and the second guide portion, the cutout portion corresponding to an axial position range which the first and second wedge members having been moved to one end in the opposite axial direction by the drive means occupy, and a circumferential gap between the first and second guide portions varies stepwise in the presence of the cutout portion.

12. A cam shaft phase controller for an internal combustion engine, comprising the phase controller described in claim 1, wherein the first rotating member is a rotating member rotated by a crank shaft of an engine and the second rotating member is a rotating member connected integrally with a cam shaft.

13. A phase controller having a first rotating member and a second rotating member adapted to be rotated through the first rotating member and controlling a phase angle as a relative rotational position between the first and second rotating members, the phase controller comprising:

a first guide portion mounted unrotatably relative to the first rotating member and occupying a part on a circumference at a certain radial position;

a second guide portion mounted unrotatably relative to the second rotating member and arranged alternately with the first guide portion in the direction of a circumference at the same radial position as the certain radial position;

a first wedge member disposed between the first and second guide portions in one circumferential direction of the first guide portion on the circumference;

a second wedge member disposed between the first and second guide portions in the other circumferential direction of the guide portion;

urging means that urge the first and second wedge members in one axial direction simultaneously; and drive means that move the first and second wedge members in an opposite axial direction, wherein the first and second wedge members are moved in the one axial direction into close contact with both the first and second guide portions by the urging means.

14. A phase controller according to claim 13, wherein the first and second guide portions each have a shape such that a circumferential gap between both the guide portions becomes smaller in the one axial direction, and the first and second wedge members disposed within the circumferential gap also each have a shape such that the circumferential size decreases in the one axial direction.

15. A phase controller according to claim 13, wherein the drive means that move the first and second wedge members in the opposite axial direction utilizes oil pressure as the driving force.

16. A phase controller according to claim 13, further comprising a plurality of oil chambers whose volumes increase or decrease in directions opposite to each other in interlock with a phase change between the first and second rotating members, the phase change being performed by controlling the feed and discharge of hydraulic oil to and from each of the oil chambers in a state in which the first and second wedge members are moved in the opposite axial direction by the drive means.

17. A phase controller according to claim 13, wherein the first and second wedge members comprise two or more pairs of first and second wedge members, and the first and second guide portions also comprise two or more pairs of first and second guide portions.

18. A valve timing controller for an internal combustion engine, comprising:

a first rotating member to which a rotating force is transmitted from a crank shaft;

a second rotating member configured to transmit a rotating force to a cam shaft;

a phase shifting mechanism mounted so as to straddle the first and second rotating members and shifting a relative rotation phase of the cam shaft with respect to the crank shaft in accordance with the state of the internal combustion engine;

contact/decontact portions adapted to move relatively in directions in which respective surfaces come into contact with or separate from each other in accordance with the shifting of the phase performed by the phase shifting mechanism, the distance between the surfaces varying in the axial direction of the first and second rotating members;

a restraint member disposed so as to be movable between the surfaces of the contact/decontact portions and adapted to restrain the phase of the phase shifting mechanism at a predetermined position in a contacted state with the surfaces of the contact/decontact portions upon movement in one axial direction of the first and second rotating members and become spaced from at least one of the surfaces of the contact/non-contact portions to release the phase-restrained state of the phase shifting mechanism upon movement in the other axial direction; and a restraint control mechanism configured to cause the restraint member to move in accordance with the state of the internal combustion engine, wherein the restraint member is disposed so as to be positioned between the surfaces of the contact/decontact portions even in the phase-restraint released state of the phase shifting mechanism device.

19. A valve timing controller for an internal combustion engine, comprising:

a first rotating member to which a rotating force is transmitted from a crank shaft;

a second rotating member configured to transmit a rotating force to a cam shaft;

a phase shifting mechanism mounted so as to straddle the first and second rotating members and shifting a relative rotation phase of the cam shaft with respect to the crank shaft in accordance with the state of the internal combustion engine;

one or a plurality of moving portions each having a pair of end faces and provided in one member which moves relatively in accordance with the shifting of the phase performed by the phase shifting mechanism;

a pair of restraint members disposed movably on both sides in the moving direction of the moving portion and adapted to, upon simultaneous movement thereof in one axial direction of the first and second rotating members, come into abutment under respective wedging actions against the pair of end faces, hold the moving body in a sandwiching manner and restrain the phase of the phase shifting mechanism at a predetermined position, while upon simultaneous movement thereof in the other axial direction of the first and second rotating members, separate from the pair of end faces to release the wedging actions, thereby releasing the restraint of the phase of the phase shifting mechanism; and a restraint control mechanism configured to cause the pair of restraint members to move in accordance with the state of the internal combustion engine, wherein the pair of restraint members are disposed so as to be kept opposed to at least one of the pair of end faces even in the phase-restraint released state of the phase shifting mechanism device.

* * * * *